United States Patent [19]

Mis

[11] 4,276,665

[45] Jul. 7, 1981

[54] BED FRAME OF ADJUSTABLE WIDTH

[75] Inventor: Frank J. Mis, Oak Lawn, Ill.

[73] Assignee: Harris Hub Co., Inc., Harvey, Ill.

[21] Appl. No.: 81,765

[22] Filed: Oct. 4, 1979

[51] Int. Cl.[3] ..... A47C 19/04

[52] U.S. Cl. ..... 5/184; 5/200 R; 403/108

[58] Field of Search ..... 5/181, 184, 200 R, 202, 5/207; 403/107, 108

[56] References Cited

U.S. PATENT DOCUMENTS

| | | | |
|---|---|---|---|
| 1,758,718 | 5/1930 | Robinson | 5/207 |
| 3,781,930 | 1/1974 | Harris | 5/200 R |
| 3,952,345 | 4/1976 | Spitz | 5/207 |
| 3,961,384 | 6/1976 | Spitz | 5/202 |
| 4,078,270 | 3/1978 | Nowell | 5/181 |
| 4,155,131 | 5/1979 | Harris et al. | 5/207 |

*Primary Examiner*—Casmir A. Nunberg

*Attorney, Agent, or Firm*—Dressler, Goldsmith, Shore, Sutker & Milnamow, Ltd.

[57] ABSTRACT

A bed frame of adjustable width includes a pair of side rails and a pair of end rails extending transversely between the side rails, with each end rail having a pair of elements, and one of the elements being provided with a series of teeth. An L-shaped pawl is mounted to one of the elements, has one leg for engaging the teeth, and a second leg engageable by a user. A thin, flat, leaf spring has one end secured to the pawl and an opposite end for engagement with the end rail.

A bracket is provided for limiting transverse movement of the box spring relative to the side rails. The bracket is secured only to a vertical leg of the side rail so that the fastener which secures the bracket to the side rail extends no higher than the top surface of the side rail or the top surface of the portion of the bracket overlying the side rail.

9 Claims, 8 Drawing Figures

10
12
12a
12b
14
14a
14b
16
18
60
3.
8.

18a
18b
24
25
35
36
40
44
47
30
32
34
48
28

20
22
18b
18a
25
23
21
16b
16a
35
36
34
24
47
46
32
30

4.
52
54
26
30
47
28
46
32
40
42
44

BED FRAME OF ADJUSTABLE WIDTH

BACKGROUND OF THE INVENTION

This invention relates to bed frames and, more particularly, to bed frames which have an adjustable width.

Bed frames for supporting a box spring and mattress above a floor typically include a pair of spaced, parallel, horizontally disposed side rails, and a pair of spaced, parallel, horizontally disposed end rails which extend substantially transversely between the side rails for holding the side rails in spaced, parallel relationship. The end rails typically comprise a pair of elements which are locked together.

A problem has long existed in the art because certain frame members of the above type have not provided positive interlocking engagement between the end rail elements and have required the use of a large number of fasteners. As a result, the assembly and disassembly of the end rail elements is time consuming and complicated and if, by chance, the width has been assembled too narrow or too wide for the particular box spring and mattress, the box spring and mattress may have to be completely removed before any readjustment of the width can be made.

Commonly assigned U.S. Pat. No. 4,078,270 to Nowell provides a solution to this problem by providing means for fastening together the elements of a transverse member of a bed frame, while still allowing for adjustments in the width of the bed frame. However, one of the disclosed embodiments requires a separate sleeve that circumscribes and protrudes outwardly from both transverse elements. In the other embodiment, the fastening means provides for adjustments in the transverse width, but does not fasten the two transverse elements together; the two elements are in the shape of C-shaped channels which are received within one another to restrain the elements in all directions except axially.

Commonly assigned U.S. Pat. No. 3,757,361 to Harris et al. discloses an adjustable transverse member that has rivets on one transverse element that are receivable in keyhole slots in the other transverse element. However, the width of the transverse member can be adjusted only to the predetermined spacing of the rivets and keyhole slots. Accordingly, variations in width can be made to accommodate queen-size or king-size bedding, but slight adjustments in width to compensate for minor variations in width of an inch or so for a particular size of bedding, such as queen-size, cannot be readily made.

Commonly assigned U.S. Pat. application Ser. No. 956,186, to Nowell filed Oct. 30, 1978, discloses another form of an adjustable bed frame. In this arrangement, keyhole slots are provided in one end rail member, protrusions are provided on the other end rail member which are receivable in the slots, and one of the slots has teeth that are engageable by a spring loaded panel. The disadvantages of this structure are the difficulties and expense in producing the end rail members with slots and protrusions, and the tab for releasing the pawl is difficult for a user to reach because the pawl and tap are positioned above the lower edge of the end rail members.

Another problem with prior art bed frames is in providing a bracket for limiting transverse movement of the bedding relative to the bed frame. Typically, this is accomplished by riveting the bracket to the side rail, and the rivet is disposed vertically with the rivet head exposed and protruding upwardly from the top surface of the side rail and bracket. As a result, the box spring does not rest upon the side rail or bracket immediately adjacent to the rivet, and this results in undesirable tension forces in the box spring and bending of the box spring.

SUMMARY OF THE INVENTION

The foregoing disadvantages of the prior art are overcome in accordance with the present invention which provides a simplified, less expensive pawl, yet a sturdier and more positive securement of the end rail elements, particularly under conditions of direct loading as when someone sits on the end of the bed, or under conditions of vibration.

In the present invention, a bed includes a pair of side rails and a pair of end rails extending transversely between the side rails. Each end rail includes first and second elongated elements each having at least one wall with an outer surface and an inner surface. The first element has a first end mounted to one end of one of the side rails and the second element has a first end mounted to one end of the other side rail. Each of the end rail elements has a second end disposed in slidable relationship to one another along the axis of the elements with the outer surface of the wall of the first element facing and engaging the inner surface of the wall of the second element.

To releasably lock together the end rail elements while permitting axial movement to adjust the width of the bed frame, one of the elements is provided with a series of teeth along one edge thereof. A generally L-shaped pawl is pivotally mounted to the other end rail element. The pawl has a first leg for engaging the teeth one at a time, and the teeth face in a direction such that the pawl is free to ride over the teeth when the two end rail elements are moved inwardly toward one another. The pawl is an integral piece stamped from sheet metal, thereby providing a pawl of reduced expense.

A thin, flat, leaf spring biasing means has one end secured to the pawl and an opposite end for engagement with an end rail element. The leaf spring biases the first leg of the pawl into engagement with one of the teeth to prevent the end rail elements from moving outwardly relative to one another. The leaf spring, as opposed to wire springs taught by the prior art, provides a more positive latching action between the pawl and the end rail element.

The pawl has a second leg which is engageable by a user to counteract the bias of the leaf spring biasing means to release the first leg from the teeth for adjusting the width of the bed frame.

A bracket is provided for limiting transverse movement of the box spring relative to the side rails. The side rails have a horizontal leg and a vertical leg extending downwardly from the horizontal leg. The bracket has a middle segment which overlies the top surface of the horizontal leg, a vertical flange extending upwardly from one end of the middle segment, and a depending flange extending downwardly from the opposite end of the middle segment. The vertical flange limits the lateral movement of the box spring. The depending flange of the bracket is secured only to the vertical leg of the side rail, so that means for securing the bracket to the side rail extends no higher than the top surface of the side rail or the middle segment of the bracket.

DESCRIPTION OF THE PREFERRED EMBODIMENTS

Figure 1:
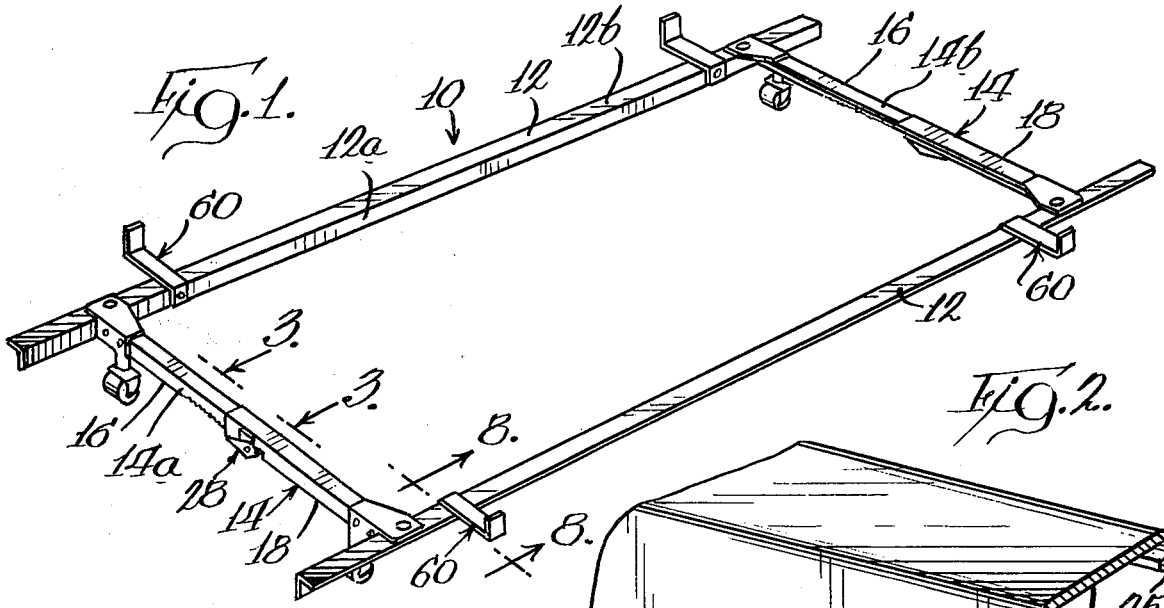
FIG. 1 is a perspective view of a bed frame incorporating the present invention.

While this invention is susceptible of embodiment in many different forms, there are shown in the drawings and herein will be described in detail preferred embodiments of the invention, with the understanding that the present disclosure is to be considered as an exemplification of the principles of the invention and is not intended to limit the invention to the embodiments illustrated. The scope of the invention will be pointed out in the appended claims.

Referring first to FIG. 1, there is shown an adjustable bed frame designated generally by the reference numeral 10. The bed frame supports mattress means, such as a box spring and mattress, in spaced relationship to a floor and includes a pair of spaced, parallel, horizontally disposed side rails 12 and a pair of spaced, parallel, horizontally disposed end rails 14. The end rails extend substantially transversely between the side rails for holding the side rails in spaced, parallel relationship. The upper surfaces of the end rails and side rails are generally coplanar and are adapted to engage and support a box spring and mattress.

Figure 4:
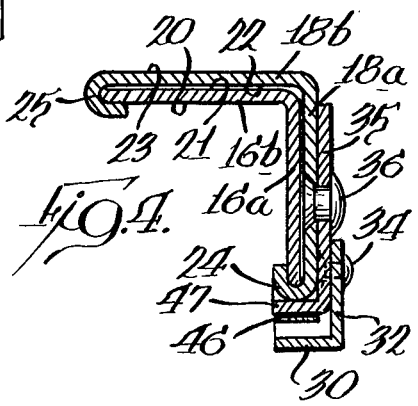
FIG. 4 is a fragmentary cross-sectional view taken along line 4—4 in FIG. 3.

Each end rail includes a pair of elongated elements 16 and 18 each having at least one wall with an inner surface 20 and 22, respectively, and an outer surface 21 and 23, respectively (FIG. 4). The first element 16 has one end mounted to one of the side rails, preferably adjacent to one end of the side rail, and the second element 18 likewise has one end mounted to the other side rail. Each of the elements has an opposite free end disposed in slidable relationship to one another along the axis of the elements 16 and 18, with the outer surface 21 of the wall of the first element 16 facing the inner surface 22 of the wall of the second element 18, as shown in FIG. 4.

The side rails 12 and end rails 14 may be formed of angle iron which is generally L-shaped in cross-section and includes a vertical leg 12*a* and 14*a*, respectively, terminating in an upper edge and a generally horizontal leg 12*b* and 14*b*, respectively, which is integral with the upper edge of the vertical leg. Likewise, elements 16 and 18 may be formed of angle iron having an L-shaped cross-section, each element having a vertical leg 16*a* and 18*a*, respectively, terminating in an upper edge, and a horizontal leg 16*b* and 18*b*, respectively, which is integral with the upper edge of the vertical leg.

Although the disclosed embodiments show elements 16 and 18 having an L-shaped cross-section, the present invention is equally applicable to a pair of elements having a channel-shaped construction such as those disclosed in the aforesaid U.S. Pat. No. 4,078,270 to Nowell.

In accordance with the present invention, the first and second elements 16 and 18 are releasably secured together and are movable axially relative to one another to adjust the width of the bed frame. To accomplish this, the horizontal legs 16*b* and 18*b* of elements 16 and 18, respectively, each have one edge integral with the vertical legs 16*a* and 18*a*, respectively, and an opposite free edge. On one of the elements 16 or 18, such as element 18, the lower edge of the vertical leg 18*a* and the free edge of the horizontal leg 18*b* are folded over to define generally U-shaped channels 24 and 25 (FIGS. 2 and 4) along element 18. In this example, the ends of the legs of element 18 are folded inwardly, and element 16 is received in element 18 such that the inner surface 22 of element 18 is juxtaposed to the outer surface 21 of element 16. The lower edge of the vertical leg 16*a* is receivable in the channel 24 defined by the vertical leg 18*a*, and the free edge of the horizontal leg 16*b* is receivable in the channel 25 defined by the horizontal leg 18*b*.

Figure 3:
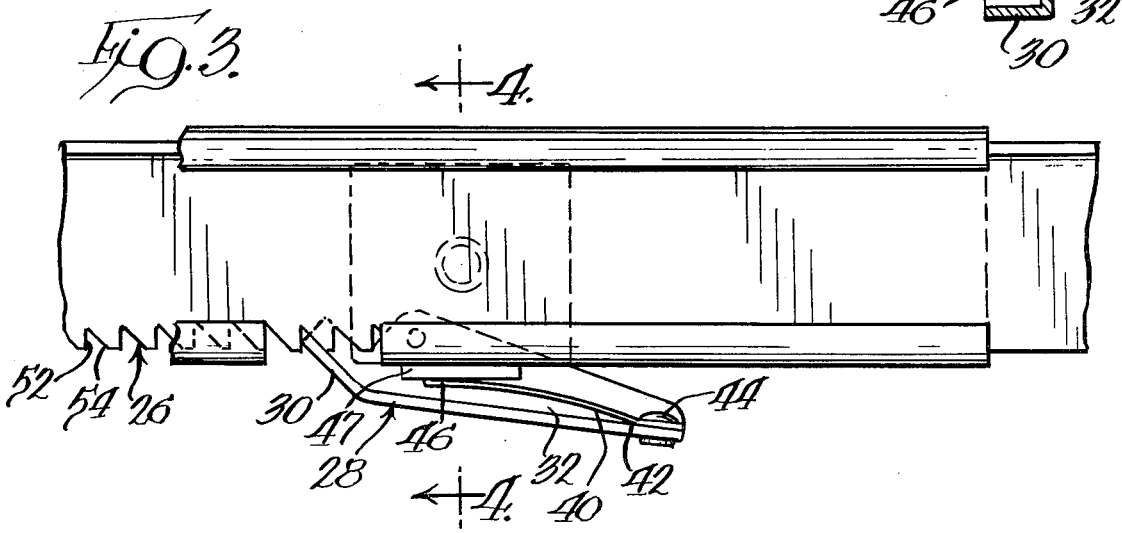
FIG. 3 is an enlarged fragmentary elevational view taken along line 3—3 in FIG. 1.

The present invention also includes means for adjusting the width of the bed frame and for positively holding the first and second elements 16 and 18 against separation. As shown in FIG. 3, the bottom edge of vertical leg 16*a* has a plurality of teeth 26 extending along the axis of the first element 16, for at least a portion of the length of the first element. Preferably, the teeth 26 are generally of a sawtooth configuration and are formed by cutting away portions of the vertical leg 16*a* along the bottom edge thereof.

Figure 2:
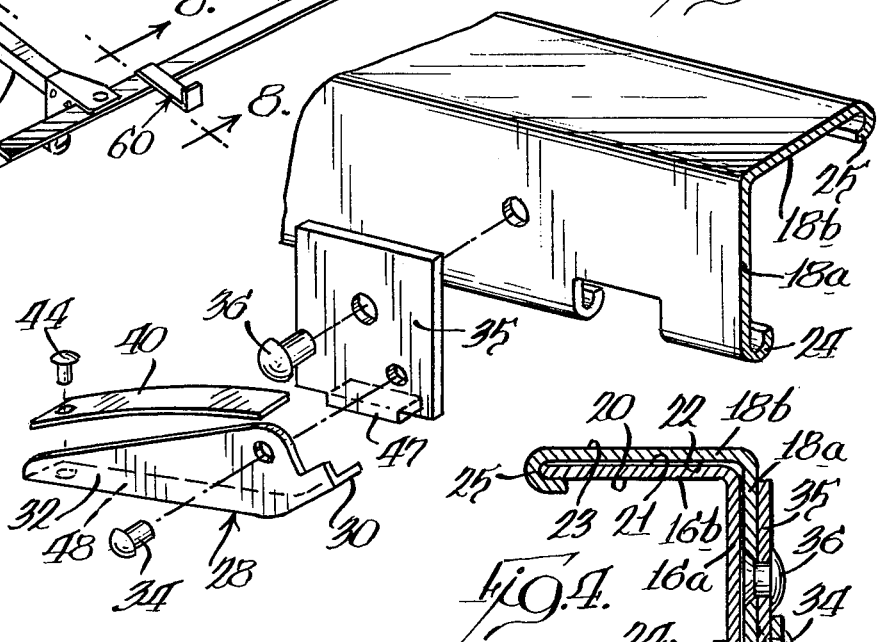
FIG. 2 is an enlarged exploded view of a portion of the bed frame shown in FIG. 1 incorporating the present invention.

The means for adjusting the width of the bed frame also includes a generally L-shaped pawl 28 pivotally mounted to the second element 18. As depicted in FIGS. 2 and 3, the pawl 28 includes a first leg 30 which engages the teeth 26 one at a time. The teeth 26 face in a direction such that leg 30 of the pawl is free to ride over the teeth when the elements 16 and 18 are moved inwardly toward one another.

The pawl 28 includes a second leg 32 which preferably overlies the outer surface 23 of the vertical leg 18*a* and is secured to the vertical leg 18*a* of the second element, preferably near the free end of the second element. The pawl is preferably a unitary member that is formed by being stamped from sheet metal, thereby providing a pawl of minimal expense.

Figure 5:
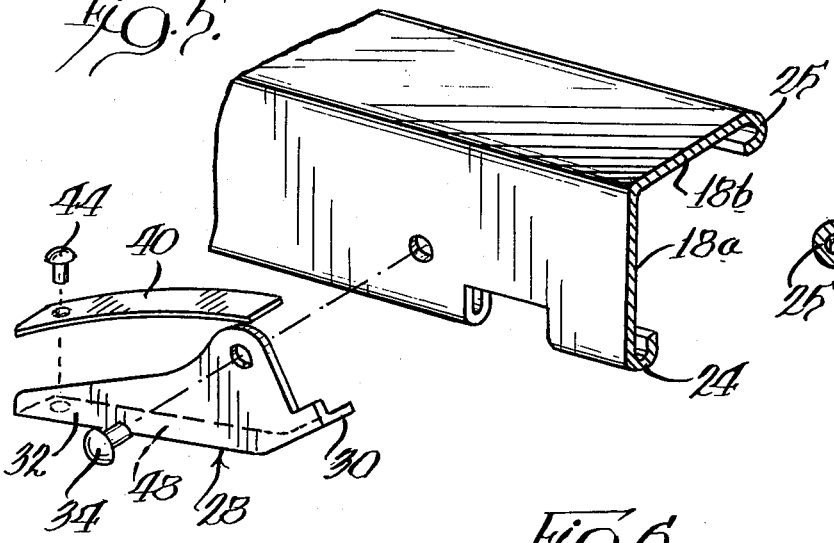
FIG. 5 is an enlarged exploded view, similar to FIG. 2, and illustrating another embodiment of the present invention.
Figure 7:
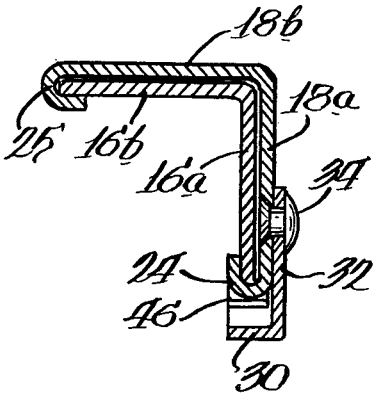
FIG. 7 is a fragmentary cross-sectional view taken along line 7—7 in FIG. 6.
Figure 6:
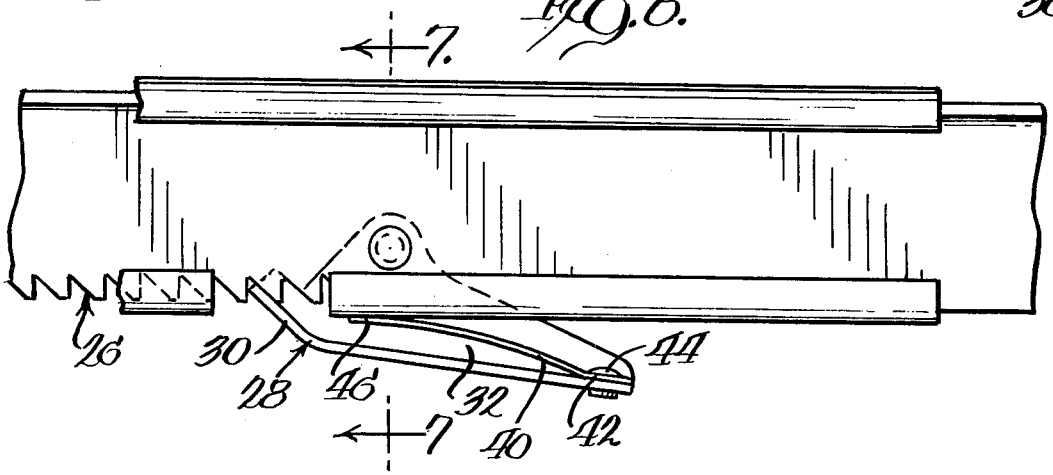
FIG. 6 is a fragmentary elevational view of the embodiment shown in FIG. 5.

The second leg 32 of the pawl is pivotally mounted directly to the vertical leg 18*a* of the second element in the preferred embodiment illustrated in FIGS. 5 through 7. The second leg 32 is secured to the vertical leg 18*a* by means of pin 34 inwardly of the edges of second leg 32.

In the embodiment shown in FIGS. 2 through 4, a mounting plate 35 overlies the outer surface 23 of the vertical leg 18*a* and is fixedly secured thereto by rivet 36. The second leg 32 overlies the mounting plate 35 and is secured to the leg mounting plate by means of pivot pin 34 inwardly of the edges of the second leg 32.

Spring biasing means, such as a thin, flat, leaf spring 40, illustrated in FIGS. 2 and 3, has a fixed end 42 which is secured to the second leg 32 by rivet 44, and an opposite end 46 which is adapted for engagement with the second element 18. The leaf spring 40 is curved when in an unrestrained condition, and is under tension at all times when secured to the pawl 28. The inherent resiliency of the leaf spring 40 urges the first leg 30 of the pawl against the teeth 26 since the fixed end 42 of the spring is attached to the second leg 32 of the pawl. The leaf spring provides a more positive latching action than wire springs disclosed in the prior art.

In the embodiment illustrated in FIGS. 2 through 4, the mounting plate 35 includes a flange 47 which may comprise a folded over portion of the mounting plate 35. The flange 47 overlies the outer surface of channel 24. In this configuration, end 46 of the leaf spring engages the flange 47.

In the embodiment shown in FIGS. 5 through 7, end 46 of the leaf spring directly engages the outer surface of the channel 24.

The second leg 32 of the pawl is engageable by a user to counteract the bias of the spring loaded pawl to release the first leg 32 from the teeth 26 for adjusting the width of the bed frame. To facilitate the engagement of the second leg 32 by the user, the second leg preferably is provided with a flange 48 (FIG. 2) that is generally perpendicular to the remainder of the second leg. The flange 48 may comprise a folded over portion of the second leg 32. At least a major portion of the second leg 32 of the pawl is disposed below the bottom edge of vertical legs 16*a* and 18*a* to further facilitate engagement of the second leg 32 by the user.

The distance along the element 16 that the teeth 26 are positioned determines the amount of variation in the width of the box springs and mattresses that can be accommodated with the present invention. Thus, where a few inches of teeth are provided, slight variations in the width of box springs and mattresses of a particular size (such as Hollywood, queen-size or king-size) can be accommodated. This feature is important because box springs of a particular size frequently vary by as much as an inch or so. Accordingly, it is only necessary to provide the teeth along a relatively short segment of the length of the first element 16.

In other instances, it is desirable to enable the bed frame to accommodate box springs and mattresses of all sizes. To accomplish this purpose, teeth 26 can be provided along a substantial portion of element 16; alternatively, several segments of teeth can be provided along the length of the element 16, e.g., a first short segment of teeth for twin-size bedding, another segment for queen size bedding, etc.

Figure 8:
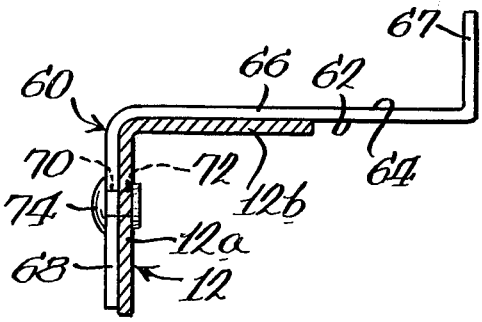
FIG. 8 is an enlarged fragmentary cross-sectional view taken along line 8—8 in FIG. 1.

In accordance with another feature of this invention, brackets 60 are secured to the side rails 12 to limit lateral movement of the box spring which is supported by the bed frame. As shown in FIG. 8, each bracket 60 has an inner face 62 and an outer face 64. The bracket has a middle segment 66, and at least a portion of the middle segment overlies and is in face-to-face contact with the top surface of the horizontal leg 12*b* of the side rail.

At one end of the middle segment 66, there is an upstanding vertical flange 67. The vertical flange 67 extends upwardly above the height of the top surface of the horizontal leg 12*b* of the side rail and limits the transverse movement of the box spring on the bed frame.

There is depending flange 68 extending downwardly from the opposite end of the middle segment 66. The inner face 62 of flange 68 overlies and is in face-to-face contact with the inside surface of the vertical leg 12*a* of the side rail. The flange 68 defines an aperture 70 that is in registration with a corresponding aperture 72 in the vertical leg 12*a* of the side rail. Each bracket 60 is secured to a side rail 12 by means of a rivet 74 or other suitable fastening means that extends through apertures 70 and 72.

By securing the bracket to the vertical leg 12*a* of the side rail, the problem of tension in the box spring from resting upon the rivet head is eliminated.

As shown in FIG. 1, four brackets 60 preferably are attached to the bed frame, with one of the brackets being positioned near each end of each side rail. Preferably, the flanges 67 and 68 are integral with the middle segment 66, and the bracket is formed of metal or other suitable materials.

What is claimed is:

1. An adjustable bed frame for supporting mattress means in spaced relationship to a floor, comprising: a pair of spaced, parallel, horizontally disposed side rails, a pair of spaced, parallel, horizontally disposed end rails extending substantially transversely between said side rails for holding said side rails in spaced, parallel relationship, each end rail including first and second elongated elements each having at least one wall, said first element having a first end mounted to one of said side rails and said second element having a first end mounted to the other of said side rails, each of said elements having a second end disposed in slidable relationship to one another along the axis of said elements, said first element having a series of teeth along one edge of said wall and extending along the axis of said first element, generally L-shaped pawl means pivotally mounted to said second element, thin, flat leaf spring biasing means having one end secured to said pawl and an opposite end for engagement with said end rail, said pawl means having one leg to engage said teeth one at a time, said teeth facing in a direction such that said pawl is free to ride over said teeth when said first and second elements are moved inwardly toward one another, engagement between said one leg of said pawl and one of said teeth preventing said first and second elements from moving outwardly relative to one another, and said pawl having a second leg which is engageable by a user to counteract the bias of the leaf spring biasing means to release said one leg from said teeth for adjusting the width of said bed frame.

2. An adjustable bed frame as defined in claim 1 wherein said elements are generally L-shaped in cross-section and include a generally vertical leg having an upper edge and a lower edge, and a generally horizontal leg integral with the upper edge of the vertical leg, said teeth are disposed along the lower edge of said vertical leg of said first element, and said second leg of said pawl means is pivotally mounted to said vertical leg of said second element, and at least a major portion of said second leg of said pawl means is disposed below the lower edge of said first and second vertical legs to facilitate engagement of said second leg of said pawl means by a user.

3. An adjustable bed frame as defined in claim 2 wherein said horizontal legs of said first and second elements have one edge integral with the vertical leg and a free edge, the lower edge of the vertical leg of the second element and the free edge of the horizontal leg of the second element are folded over to define generally U-shaped channels along the second element, the lower edge of the vertical leg of the first element is receivable in the channel defined by the vertical leg of the second element, and the free edge of the horizontal leg of the first element is receivable in the channel defined by the horizontal leg of the second element, whereby said first and second elements are movable axially relative to one another.

4. An adjustable bed frame as defined in claim 2 wherein said second leg of said pawl means is pivotally mounted directly to said vertical leg of said second element inwardly of the edges of said second leg.

5. An adjustable bed frame as defined in claim 2 wherein a mounting plate is secured to the vertical leg of said second element, and said vertical flange of said pawl means is pivotally mounted to said mounting bracket.

6. An adjustable bed frame as defined in claim 1 wherein said flat leaf spring biases said one leg of said pawl means in engagement with said teeth, said leaf spring having one end secured to said second leg of said pawl means and an opposite end which engages said second element.

7. An adjustable bed frame for supporting mattress means in spaced relationship to a floor, comprising: a pair of second, parallel, horizontally disposed side rails, a pair of spaced, parallel, horizontally disposed end rails extending substantially transversely between said side rails for holding said side rails in spaced, parallel relationship, each end rail including first and second elongated elements that are generally L-shaped in cross-section and include a generally vertical leg having an upper edge and a lower edge, and a generally horizontal leg integral with the upper edge of the vertical leg, said first element having a first end mounted to one of said side rails and said second element having a first end mounted to the other of said side rails, each of said elements having a second end disposed in slidable relationship to one another along the axis of said elements, said horizontal legs of said first and second elements have one edge integral with the vertical leg and a free edge, the lower edge of the vertical leg of the second element and the free edge of the horizontal leg of the second element are folded over to define generally U-shaped channels along the second element, the lower edge of the vertical leg of the first element is receivable in the channel defined by the vertical leg of the second element, and the free edge of the horizontal leg of the first element is receivable in the channel defined by the horizontal leg of the second element, said first element having a series of teeth disposed along the lower edge of the vertical leg of said first element and extending along the axis of said first element, generally L-shaped pawl means pivotally mounted to said second element, thin, flat leaf spring biasing means having one end secured to said pawl and an opposite end for engagement with said side rail, said pawl means having one leg to engage said teeth one at a time, said teeth facing in a direction such that said pawl is free to ride over said teeth when said first and second elements are moved inwardly toward one another, engagement between said one leg of said pawl and one of said teeth preventing said first and second elements from moving outwardly relative to one another, and said pawl means having a second leg which is pivotally mounted directly to said vertical leg of said second element, and at least a major portion of said second leg of said pawl means is disposed below the lower edge of said first and second vertical legs to facilitate engagement of said second leg of said pawl means by a user to counteract the bias of the leaf spring biasing means to release said one leg from said teeth for adjusting the width of said bed frame.

8. A bed frame for supporting mattress means in spaced relationship to a floor, comprising: a pair of spaced, parallel, horizontally disposed side rails, a pair of spaced, parallel, horizontally disposed end rails extending substantially transversely between said side rails for holding said end rails in spaced, parallel relationship, each side rail having a horizontal leg with a top surface, and a vertical leg extending downwardly from said horizontal leg, and bracket means for limiting transverse movement of said mattress means relative to said side rails, said bracket means having a middle segment, at least a portion of said middle segment overlying and in face-to-face contact with said top surface of said horizontal leg, a vertical flange extending upwardly from one end of said middle segment for limiting transverse movement of said mattress means, and a depending flange extending downwardly from the opposite end of said middle segment, at least a portion of said depending flange of said bracket means overlying and in face-to-face contact with said downwardly extending vertical leg of said side rail, and means for securing said depending flange of said bracket means to said vertical leg of said side rail.

9. A bed frame as defined in claim 8 wherein said depending flange and said vertical leg each define aperture means in registration with one another, and fastening means extends through said apertures in said depending flange and said vertical leg to secure said bracket to said side rail.

* * * * *